United States Patent [19]

Baxter

[11] Patent Number: 4,890,671

[45] Date of Patent: Jan. 2, 1990

[54] POLISHED ROD LINER PULLER ASSEMBLY

[76] Inventor: Bill V. Baxter, 401 Princeton, Liberal, Kans. 67901

[21] Appl. No.: 294,422

[22] Filed: Jan. 9, 1989

[51] Int. Cl.[4] ..... E21B 19/02

[52] U.S. Cl. ..... 166/250; 166/77.5; 166/377; 254/30

[58] Field of Search ..... 166/77.5, 85, 75.1, 166/96, 377, 378, 379; 254/29 R, 30, 31, 93 R

[56] References Cited

U.S. PATENT DOCUMENTS

| | | | |
|---|---|---|---|
| 1,343,821 | 6/1920 | Hatch | 166/77.5 |
| 2,592,168 | 4/1952 | Morris et al. | 254/30 X |
| 2,604,171 | 7/1952 | Houser | 166/77.5 |
| 3,290,006 | 12/1966 | Dubberke | 166/77.5 |
| 3,316,963 | 5/1967 | Boldrick et al. | 254/30 X |
| 3,331,585 | 7/1967 | Dubberke | 166/77.5 X |
| 4,209,066 | 6/1980 | Watson | 166/377 |
| 4,479,537 | 10/1984 | Reed | 166/85 X |

*Primary Examiner*—Stephen J. Novosad
*Attorney, Agent, or Firm*—Phillip A. Rein

[57] ABSTRACT

This invention relates to a polished rod liner puller assembly and method of use having a plurality of interconnectable elements being (1) a spacer stand assembly; (2) a work table assembly mountable upon the spacer stand assembly; (3) a base plate assembly mountable upon a top surface of the work table assembly; (4) piston and cylinder jack assemblies pivotally connected to an upper surface of the base plate assembly; and (5) a winged rod clamp assembly connected to an outer end of the piston and cylinder jack assemblies and connectable to a polished rod liner assembly for axial movement thereof and subsequent replacement of a polished rod liner member. The work table assembly and base plate assembly are provided with U-shaped slot sections so as to be readily mountable about the existing pipe members in a well casing head assembly. The method of use of the polished rod liner puller assembly is operable to be placed about a well casing head assembly and a polished rod liner assembly for connection thereto for controlled vertical movement within a stuffing box assembly to remove and replace a worn polished rod liner member.

15 Claims, 3 Drawing Sheets

FIG. 1
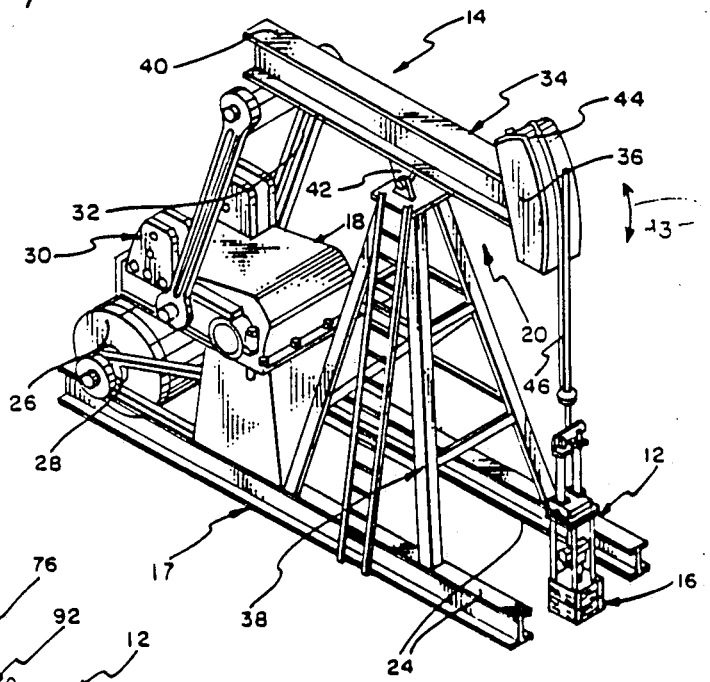
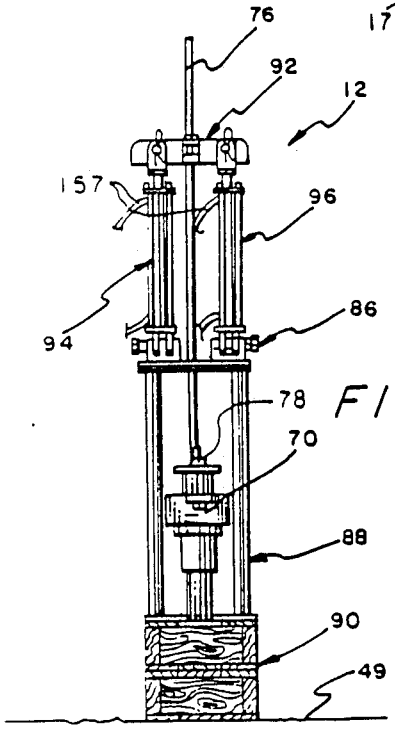
FIG. 2
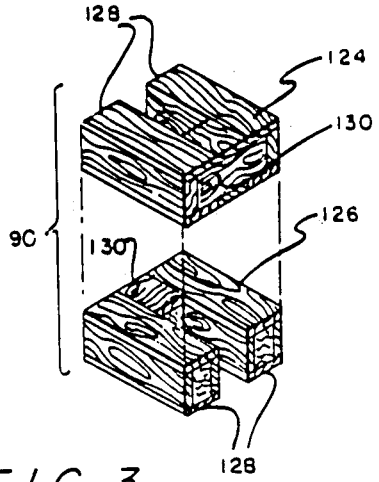
FIG. 3

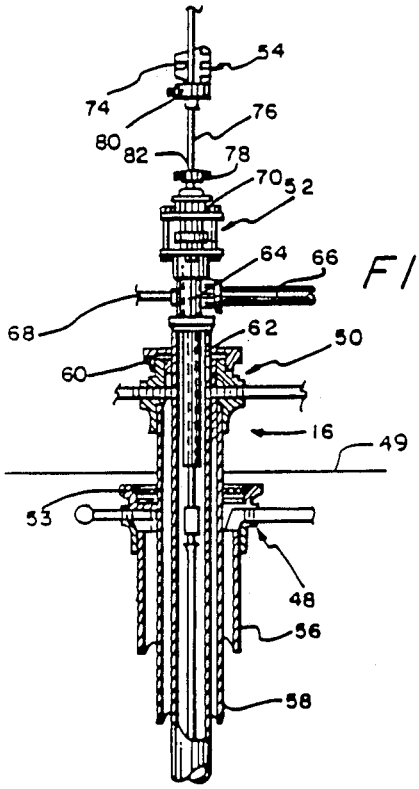
FIG. 8
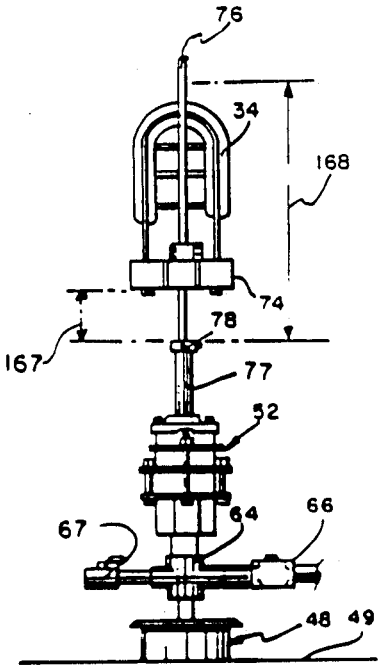
FIG. 9
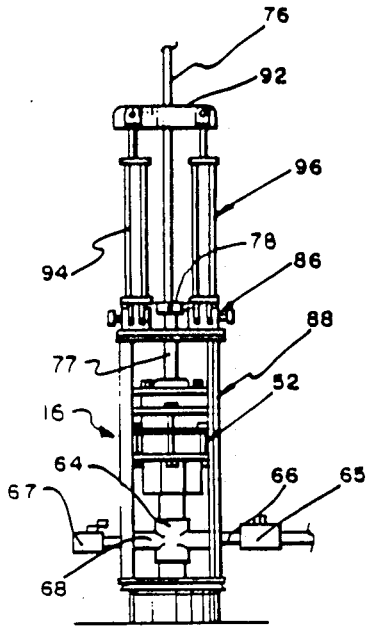
FIG. 10
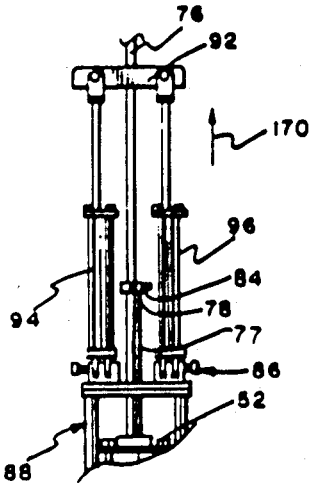
FIG. 11
FIG. 13
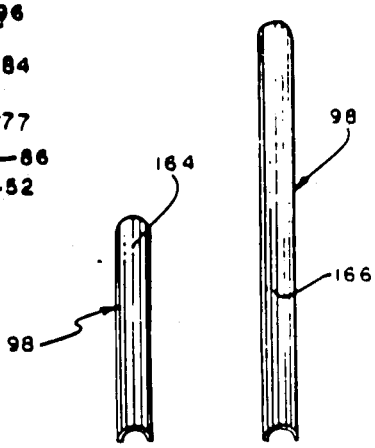
FIG. 12

POLISHED ROD LINER PULLER ASSEMBLY

The two Dubberke patents disclose a pipe pulling device being portable and having piston and cylinder members to grasp and elevate pipe from a well.

The Hatch patent discloses a tool for replacing sucker rods having a clamp plate for preventing downward movement of the sucker rod within the well.

PREFERRED EMBODIMENT OF THE INVENTION

In one preferred embodiment of this invention, a polished rod liner puller assembly and method of use is utilized with a well pumper assembly operable with a well casing head assembly to remove fluid from a well structure during a normal well pumping operation. The polished rod liner puller assembly is operable to grasp a polished rod member of a polished rod liner assembly and to move the polished rod member and interconnected polished rod liner member therefrom which needs periodic replacement. The polished rod liner puller assembly includes (1) a base plate assembly; (2) a work table assembly oprable to have the base plate assembly mounted thereon; (3) a spacer stand assembly mountable between the work table assembly and a support surface to provide the necessary height positioning; (4) a winged rod clamp assembly releasably connectable to the polished rod member; (5) piston and cylinder jack assemblies mountable between the base plate assembly and extendable upwardly about the polished rod liner member; and (6) an extension tube assembly operable to aid in removal of the polished rod member. The work table assembly is operable to be placed about the well casing head assembly and the polished rod liner assembly on the support surface or selectively elevated therefrom by use of the spacer stand assembly. The base plate assembly is mounted on an upper surface of the work table assembly with the piston and cylinder jack assemblies connected thereto. The winged rod clamp assembly is operable to be clamped onto an upper portion of the polished rod member and attached to an upper portion of the piston and cylinder jack assemblies. The piston and cylinder jack assemblies are operable to be extended under hydraulic fluid to move the polished rod member relative to the well casing head assembly to move the polished rod liner member concurrently upwardly out of a well structure for removal and replacement thereof. The method of use of the polished rod liner puller assembly of this invention involves the steps of (1) setting both the well pumper assembly and a hand brake in a down stroke position; (2) opening valve members to relieve any fluid pressure in the well pumper assembly and prevent backflow of fluid to the well structure; (3) measuring distances from a bridle clamp member to the polished rod liner member and to the top of the polished rod member in order to correctly position a new polished rod liner member on the polished rod member; (4) mounting the work table assembly about the well casing head assembly and the polished rod member which is extended upwardly therefrom; (5) placing the base plate assembly on an upper surface of the work table assembly; (6) connecting the piston and cylinder jack assemblies to the base plate assembly being respectively extended on opposed sides of the polished rod member; (7) connecting the winged rod clamp assembly to movable piston rods of the piston and cylinder jack assemblies; (8) securing the winged rod clamp assembly to an upper outer portion of the polished rod member; (9) raising the polished rod member by actuation of the piston and cylinder jack assemblies and removing the bridle clamp member on the well pumper assembly; (10) lowering the polished rod member and interconnected polished rod liner member to a rod liner nut member on the work table assembly; (11) releasing the rod liner nut member from the polished rod liner member and removing any packing rubbers therein; (12) extending the piston and cylinder jack assemblies to move the polished rod liner member from the stuffing box assembly; (13) removing and replacing the old polished rod liner member with a new polished rod liner member; (14) mounting and connecting the rod liner nut member about the new polished rod member; (15) connecting the bridle clamp member of the well pumper assembly to the polished rod member; (16) removing the polished rod liner puller assembly; and (17) activating the well pumper assembly into its normal mode of well pumping operation.

OBJECTS OF THE INVENTION

One object of this invention is to provide a polished rod liner puller assembly which is readily portable and usable on remote location well pumper assemblies to remove and replace a polished rod liner member without the use of extensive equipment and labor expense.

One further object of this invention is to provide a polished rod liner puller assembly which can be utilized by a single operator to be connected to a polished rod liner assembly of a well pumper assembly which is operable to grasp and elevate a polished rod liner through the use of piston and cylinder jack assemblies for easy replacement of a worn polished rod liner member.

One other object of this invention is to provide a polished rod liner puller assembly having a plurality of interconnectable parts to be placed about a polished rod liner assembly of a well casing head assembly utilizing a minimum amount of equipment to remove a polished rod liner member not requiring the large and expensive equipment of the prior art structure and method of use in removing a polished rod liner member.

One further object of this invention is to provide a polished rod liner puller assembly which is sturdy in construction; easy to use; and substantially maintenance free.

Still, one further object of this invention is to provide a method of use of a polished rod liner puller assembly involving easy to follow steps for removing and replacing a polished rod liner member in a well casing head assembly of a well pumper assembly.

Various other objects, advantages and features of the invention will become apparent to those skilled in the art from the following discussion, taken in conjunction with the accompanying drawings, in which:

FIGURES OF THE INVENTION

FIG. 1 is a well pumper assembly illustrated as having a polished rod liner puller assembly of this invention mounted thereon;

FIG. 2 is a fragmentary front elevational view of the polished rod liner puller assembly attached to a portion of a polished rod liner assembly;

FIG. 3 is a perspective view of a spacer stand assembly of the polished rod liner puller assembly of this invention;

FIG. 8 is a fragmentary sectional view of a well casing head assembly utilized with the well pumper assembly to achieve a well pumping operation;

FIGS. 9–11 illustrate method steps of utilizing the polished rod liner puller assembly of this invention on the well casing head assembly; and FIGS. 12–13 are perspective views of a split tubing assembly of the polished rod liner assembly of this invention.

Figure 4:
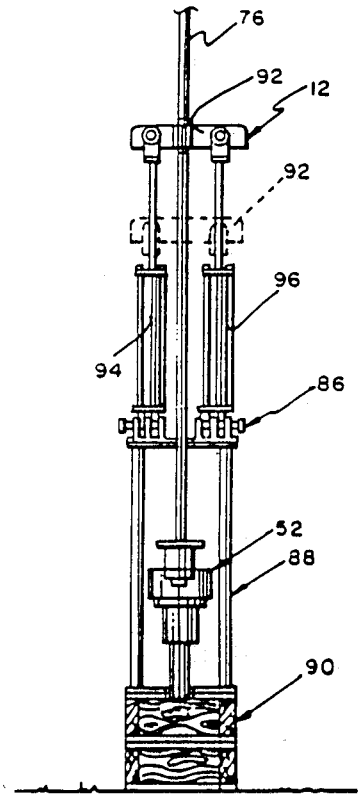
FIG. 4 is a front elevation view similar to FIG. 2 illustrating piston and cylinder jack assemblies in an extended position.

The following is a discussion and description of preferred specific embodiments of the polished rod liner puller assembly and method of use of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a polished rod liner puller assembly of this invention, indicated generally at 12, is illustrated as utilized with a well pumper assembly 14 operably connected to a well casing head assembly 16.

The well pumper assembly 14 includes (1) a main support frame 17; (2) a power plant assembly 18 mounted upon the support frame 17; and (3) a horsehead pumper assembly 20 mounted upon the support frame 17 and operably connected to the power plant assembly 18. The main support frame 17 includes a pair of spaced parallel support beams 24 mounted upon an adjacent support surface.

The power plant assembly 18 includes a motor member 26 operable through a belt and pulley assembly 28 to rotate a crank arm assembly 30. The crank arm assembly 30 includes a linkage arm 32 connected to the horsehead pumper assembly 20 to achieve pivotal movement thereof for a normal well pumping operation used in oil and gas wells.

The horsehead pumper assembly 20 includes (1) a main horsehead member 34 having one end connected to the linkage arm 32; (2) a cable head member 36 mounted on an outer end of the horsehead member 34 and operably connected to the well casing head assembly 16; and (3) a support tower member 38 of a generally A-frame structure.

The horsehead member 34 includes an I-Beam body member 40 having a central pivot connector 42 mounted on the support tower member 38 for the arcuate pivotal movement as noted by an arrow 43 in FIG. 1.

The cable head member 36 is provided with a cable connector 44 interconnected to a cable line 46 which, in turn, is connected to the well casing head assembly 16 through a bridle clamp member for vertical reciprocal movement as will be explained.

As noted in FIG. 8, the well casing head assembly 16 includes (1) a casing head assembly 48; (2) a tubing head assembly 50 connected to the casing head assembly 48; (3) a stuffing box assembly 52 mounted upon the tubing head assembly 50; and (4) a polished rod liner assembly 54 mounted within the stuffing box assembly 52 for a reciprocal fluid pumping operation.

The casing head assembly 48 is extended just below a ground level 49 and includes (1) a casing head member 53; (2) a surface pipe 56 connected to the casing head member 53 and extended downwardly into the well structure; and (3) an oil string casing 58 mounted within the outer surface pipe 56.

The tubing head assembly 50 is provided with a tubing head member 60, a well tubing string 62 extended downwardly through the tubing head assembly 50, and a connector head member 64 mounted on the tubing head member 60.

The connector head member 64 is connected to a fluid flow line 66 and a bleeder line 68. The fluid flow line 66 is operable to take the fluid from the well and move same laterally therefrom due to the pumping action of the well pumper assembly 14.

As noted in FIG. 10, the fluid flow line 66 has a combination check and on-off valve member 65 therein to insure that the fluid flow only goes in an outward direction and selectively closes the fluid flow line 66 when necessary as will be explained. The bleeder line 68 is provided with a bleeder valve member 67 which will be opened during operation of this invention in removing a polished rod liner assembly 54.

The stuffing box assembly 52 is provided with a main housing assembly 70 positioned about and above the connector head member 64.

The polished rod liner assembly 54 includes (1) a crown box assembly 74 connected to an adjacent portion of the cable line 46 of the horsehead pumper assembly 20; (2) a polished rod member 76 connected at one end to the crown box assembly 74 and extended downwardly through the stuffing box assembly 52; (3) a polished rod liner member 77 mounted about the polished rod member 76 and extended into the stuffing box assembly 52; and (4) a rod liner nut member 78 connected above an upper portion of the stuffing box assembly 52 to the polished rod member 76.

The crown box assembly 74 includes a bridle clamp member 80 for connecting the polished rod member 76 to the cable line 46 for the well pumping operation.

The rod liner nut member 78 is threadably connected to a top end of the polished rod liner member 77 and includes a nut member 82 having set screws 84 for anchoring against rotation.

The polished rod liner puller assembly 12 includes a plurality of elements being (1) a base plate assembly 86; (2) a work table assembly 88; (3) a spacer stand assembly 90; (4) a winged rod clamp assembly 92; (5) piston and cylinder jack assemblies 94, 96; and (6) an extension tube assembly 98.

Figure 5:
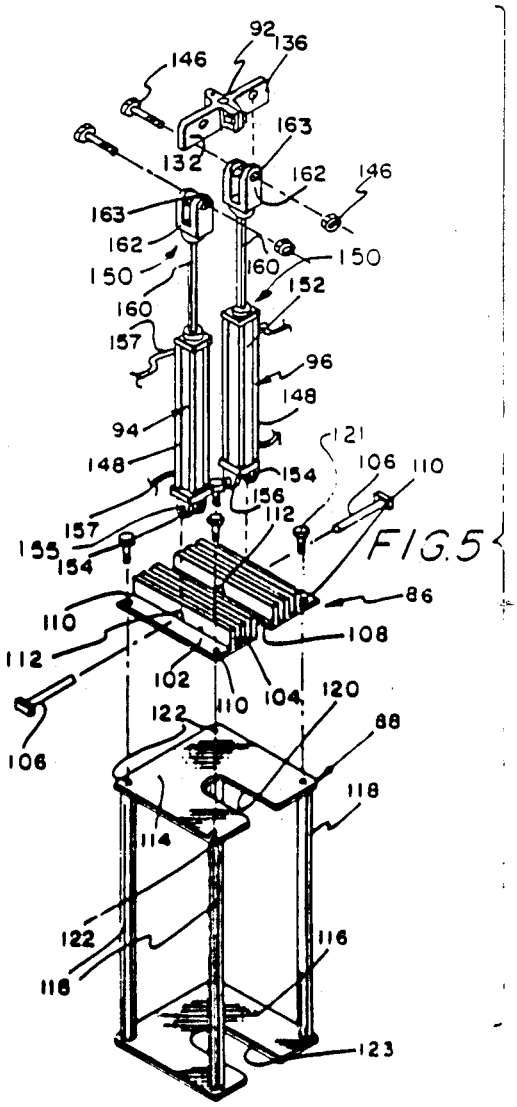
FIG. 5 is an exploded perspective view of the polished rod liner puller assembly of this invention.
Figure 6:
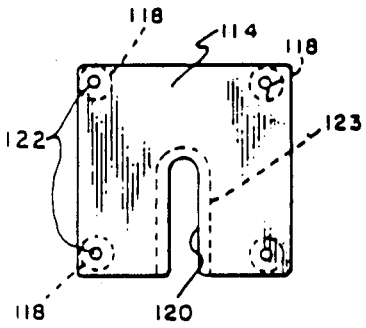
FIG. 6 is a top plan view of a work table assembly of the polished rod liner puller assembly of this invention.

As noted in FIG. 5, the base plate assembly 86 includes (1) a base plate member 102; (2) a plurality of adjacent spaced parallel support rails 104 extended upwardly from an upper surface of the base plate member 102; and (3) anchor rod members 106 for connection of the piston and cylinder jack assemblies 94, 96 to the support rails 104 as will be explained.

The base plate member 102 is provided with a U-shaped slot section 108 along one edge thereof and anchor holes 110 positioned in the corners for anchoring to the work table assembly 88 as will be noted.

The parallel support rails 104 are respectively provided with centrally positioned and aligned connector holes 112 to receive respective ones of the anchor rod members 106 therein.

The work table assembly 88 includes an upper plate member 114 and a lower plate member 116 interconnected by parallel support tube members 118. The upper plate member 114 is provided with a U-shaped slot portion 120 along one edge thereof and a plurality of threaded anchor holes 122 operable to receive anchor bolt members 121 therein. The bolt members 121 are used to secure the work table assembly 88 to the base plate member 102 when placed through the anchor holes 110.

The lower plate member 116 is similar to the upper plate member 114 having a U-shaped slot portion 123 vertically aligned with the slot portion 120 in the upper plate member 114.

As noted in FIG. 3, the spacer stand assembly 90 is provided with first and second stand members 124, 126 to provide a support means for elevating the work table assembly 88 from the support ground surface 49 when deemed necessary.

The first and second stand members 124, 126 are identical, each having parallel leg sections 128 interconnected by a connector leg section 130. The parallel leg sections 128 has an open portion therebetween to permit the same to be placed around the oil string casing 58.

Figure 7:
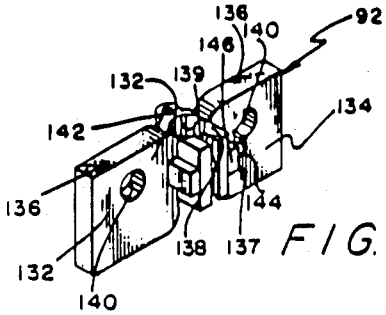
FIG. 7 is a perspective view of a winged rod clamp assembly of the polished rod liner puller assembly of this invention.

As noted in FIG. 7, the winged rod clamp assembly 92 includes a first wing member 132 interconnected to a second wing member 134 by a connector assembly 137. The first wing member 132 includes a support body 136 integral with a rod clamp section 138. The support body 136 has a connector hole 140 for connecting to a portion of the piston and cylinder jack assemblies 94, 96 as will be explained.

The rod clamp section 138 is provided with an arcuate rod groove 139 to be placed about and clamped onto a portion of the polished rod member 76 during the method of use of this invention.

The second wing member 134 is substantially identical to the first wing member 132 extended in an opposite direction having the support body 136 with a connector hole 140 therein and a rod clamp section 138 having a rod groove 139 therein.

The connector assembly 137 includes a pivot pin member 142 interconnecting overlapping portions of the first and second wing members 132, 134 similar to a door hinge structure and an anchor member 144. The anchor member 144 is provided with a nut and bolt member 146 engagable with the rod clamp section 138 of the support body 136 to clamp same about the polished rod member 76.

The piston and cylinder jack assemblies 94, 96 are substantially identical having a cylinder assembly 148 with a piston assembly 150 mounted therein and fluid control lines 157 connected to the cylinder assembly 148. The cylinder assembly 148 includes a cylinder member 152 having anchor plates 154 with aligned anchor holes 155 at one end thereof which are connectable to the base plate assembly 86 as will be noted.

Each piston assembly 150 includes a piston member mounted within the cylinder assembly 148 and having a piston rod member 160 extended upwardly therefrom. On an outer end of the piston rod member 160 is mounted a connector yoke 162 having yoke connector holes 163 therein which are connectable to the winged rod clamp assembly 92 by nut and bolt members 146. The fluid control lines 157 are operable to be connected to a fluid pump and motor assembly (not shown) and having control levers thereon to selectively and jointly activate the piston and cylinder jack assemblies 94, 96 to extend the piston rod members 160 to move the winged rod clamp assembly 92 and interconnected polished rod member 76.

As noted in FIGS. 12 and 13, the extension tube assembly 98 includes a first split tube member 164 and a second split tube member 166 twice the length of the first split tube member 164 to be used as a shim member to be placed about the polished rod member 76 for achieving additional extended movement in the method and use of this invention.

The first and second tube members 164, 166 are of a halfcylindrical shape so they can be installed about the polished rod liner member 77 without being placed over and about an upper end of the polished rod member 76 which would be required if each was a cylindrical tube member instead of a semi-circular shape.

USE AND OPERATION OF THE INVENTION

In the use and operation of the polished rod liner puller assembly 12 of this invention, the elements thereof are shown in exploded perspective in FIG. 5 and includes the spacer stand assembly 90 illustrated in FIG. 3. The spacer stand assembly 90 with the first and second stand members 124, 126 are operable, when necessary, to provide a desired elevational postioning of the work table assembly 88 as noted in FIG. 2. The spacer stand assembly 90 is operable to be placed about the tubing head assembly 50 with the polished rod liner assembly 54 extended upwardly therefrom.

The work table assembly 88 is then placed on the ground surface 49 or on an upper surface of the spacer stand assembly 90 (if needed) with the slot portions 120, 123 mounted about the tubing head assembly 50 and the polished rod liner assembly 54 as noted in FIG. 4.

Next, the base plate assembly 86 is placed on the upper plate member 114 and positioned so as to move the U-shaped slot section 108 about the polished rod liner assembly 54. The bolt members 121 are then extended through the aligned openings 110 in the base plate member 102 and threaded within the threaded anchor holes 122 in the upper plate member 114 to anchor same thereto.

The piston and cylinder jack assemblies 94, 96 and, more particularly, the anchor plates 154 are placed between the support rails 104 and pivotally connected thereto through the use of the anchor rod members 106.

The winged rod clamp assembly 92 is operable to be opened and mounted about the polished rod member 76 and secured thereto through the use of the connector assembly 137 and, more specifically, the nut and bolt member 146. At this time, the support bodies 136 of the first and second wing members 132, 134 are secured by nut and bolt members 146 to the connector yokes 162 of the piston and cylinder jack assemblies 94, 96.

METHOD OF USE OF THE INVENTION

In the method of use of the invention as illustrated in FIGS. 9–11, inclusive, and, more specifically, FIG. 9 illustrates the power plant assembly 18 is de-energized and the horsehead member 34 is presently connected by the bridle clamp member 50 to the polished rod member 76. The first step is for the operator to measure the distance between the bridle clamp member 80 of the crown box assembly 74 and the polished rod liner member 77 as illustrated by arrow 167. Also, a measurement is taken from the top of the rod liner nut member 78 to the top of the polished rod member 76 as indicated by numeral 168 in order to install a new polished rod liner member 77 in the right position.

Next, the rod liner nut member 78 is loosened on unscrewing the same from its connection to the polished rod liner member 77 and any O-rings or packing rubbers.

The well pumper assembly 14 is placed in the down stroke position so that the weight of the movable pumping stand or sucker rod assembly is placed on a bottom surface of the well being worked thereupon. The bleeder valve member 66 is then opened to relieve any pressure within the well casing head assembly 16. The valve member 66 is closed to prevent any fluid backflowing into the well casing head assembly 16.

Next, the work table assembly 88 is either supported on the ground surface 49 or placed at a proper height with use of the spacer stand assembly 90. The base plate assembly 86 is then placed on the top surface of the upper plate member 114 and secured thereto with the bolt members 121. It is seen that the U-shaped slot portions 120, 123 of the work table assembly 88 and the U-shaped slot section 108 of the base plate assembly 86 are placed about the tubing head assembly 50 of the well casing head assembly 16.

The piston and cylinder jack assemblies 94, 96 are thereupon interconnected through the anchor plates 154 of the cylinder assemblies 148 by the anchor rod members 106 to the parallel support rails 104 of the base plate assembly 86. The pivotal connection allows for limited lateral movement during use thereof.

The winged rod clamp assembly 92 is then connected to the connector yokes 162 of the piston assemblies 150 and, concurrently, secured in a clamped manner about an upper portion of the polished rod member 76.

Next, the piston and cylinder jack assemblies 94, 96 are actuated to move the polished rod member 76 a short distance whereupon the bridle clamp member 80 can be removed. Next, the piston and cylinder jack assemblies 94, 96 are extended to the upper position as noted by arrow 170 in FIG. 11 which moves the interconnected polished rod liner member 77 outwardly from the well casing head assembly 16.

In some cases where the polished rod liner member 77 is not free to be moved due to corrosion or the like, the extension tube assembly 98 is used. The first tube member 164 is about half the length of the second tube member 166 and are used independently as shims between the rod liner nut member 78 and the winged rod clamp assembly 92.

For example, when the polished rod liner member 77 is not free but pulled upwardly the full stroke of the piston rod members 160, the winged rod clamp assembly 92 is loosened and the piston rod members 160 are retracted. Then, the first split tube member 164 is placed between a top surface of the winged rod clamp assembly 92 and the rod liner nut member 78 which has been threaded back on the polished rod liner member 77.

The lowered winged rod clamp assembly 92 is reconnected to the polished rod member 76 and the piston rod members 160 hydraulically extended in a second attempt to free the polished rod liner member 77.

If the polished rod liner member 77 is still not freed, the steps above would be repeated with the second split tube member 166 to achieve further axial movement of the polished rod liner member 77.

The winged rod clamp assembly 92 is then removed from the polished rod member 76 and the loosened polished rod liner member 77 is removed and replaced with a new one.

The bridle clamp member 80 is reconnected to the cable line 46 and the polished rod member 76. The polished rod liner puller assembly 12 can thereupon be removed and the well pumper assembly 14 can be reconnected to start a well pumping operation.

In summary, the method of use of the polished rod liner puller assembly 12 of this invention involves the steps of (1) setting the well pumper assembly 14 in the down stroke position; (2) removing pressure from the fluid pumping operation; (3) measuring distances from the bridle clamp member 80 to assure accuracy in reassembling; (4) mounting the work table assembly 88 about the well casing head assembly 16 using the spacer stand assembly 90 as needed; (5) placing the base plate assembly 86 on an upper surface of the work table assembly 88; (6) connecting the piston and cylinder jack assemblies 94, 96 to the base plate assembly 86 respectively extended on each side of the polished rod member 76; (7) connecting the winged rod clamp assembly 92 to the piston and cylinder jack assemblies 94, 96; (8) securing the winged rod clamp assembly 92 to an upper portion of the polished rod member 76; (9) raising the polished rod member 76 by actuation of the piston and cylinder jack assemblies 94, 96 and removing the bridle clamp member 80 on the well pumper assembly 14; (10) lowering the polished rod member 76 to the down stroke position to rest a rod liner nut member 78 on the work table assembly 88 and loosening the rod liner nut member 78; (11) extending the piston and cylinder jack assemblies 94, 96 to move the polished rod member 76 upwardly from the stuffing box assembly 52 and release the polished rod liner member 77; (12) removing and replacing the old polished rod liner member 77 with a new one; (13) mounting and connecting a rod liner nut member 78 about the new polished rod liner member 77; (14) connecting the bridle clamp member 80 of the well pumper assembly 14 to the new polished rod liner member 77 and the cable line 46; (15) removing the polished rod liner puller assembly 12; and (16) activating the well pumper assembly 14 into its normal mode of well pumping operation.

It is seen that the polished rod liner puller assembly of this invention is composed of a plurality of interconnected elements which can be readily assembled, disassembled, and transported to a possible remote location of a well pumper assembly to remove a polished rod liner member without the use of expensive and heavy equipment as previously utilized in the prior art. The polished rod liner puller assembly is sturdy in construction; economical to manufacture; relatively easy to use; and substantially maintenance free.

While the invention has been described in conjunction with preferred specific embodiments thereof, it will be understood this description is intended to illustrate and not to limit the scope of the invention, which is defined by the following claims:

I claim:

1. A polished rod liner puller assembly operable with a well casing head assembly to remove a polished rod liner member of a polished rod liner assembly from a well, comprising:

(a) a work table assembly operable to be placed around the well casing head assembly and enclose the polished rod liner assembly;

(b) a base plate assembly mounted on said work table assembly;

(c) a piston and cylinder jack assembly mounted on said base plate assembly and extended upwardly therefrom; and (d) a winged rod clamp assembly connectable to said piston and cylinder jack assembly and to a polished rod member of the polished rod liner assembly and operable on actuation of said piston and cylinder jack assembly to axially move the polished rod member and the polished rod liner member to remove the polished rod liner member from the well.

2. A polished rod liner puller assembly as described in claim 1, wherein:

(a) said work table assembly having upper and lower plate members interconnected by support tube members; and (b) said upper and lower plate members having slot portions to be extended about the well casing head assembly.

3. A polished rod liner puller assembly as described in claim 1, wherein:

(a) said base plate assembly having a plurality of parallel support rails mounted on a base plate member and having an anchor rod member for connecting same to said piston and cylinder jack assembly.

4. A polished rod liner puller assembly as described in claim 3, wherein:

(a) said piston and cylinder jack assembly having a piston assembly mounted with a cylinder assembly and a connector yoke which is operably connected between said support rails of said base plate assembly by said anchor rod member allowing pivotal movement thereof.

5. A polished rod liner puller assembly as described in claim 1, including:

(a) a spacer stand assembly having a first stand member to be mounted under said work table assembly to achieve the necessary height positioning of said work table assembly relative to the well casing head assembly.

6. A polished rod liner puller assembly as described in claim 1, wherein:

(a) said winged rod clamp assembly having first and second wing members pivotally connected to each other and having a rod clamp section adapted to be placed about said polished rod member and clamped thereto for movement therewith on actuation of said piston and cylinder jack assembly.

7. A polished rod liner puller assembly as described in claim 1, wherein:

(a) another of said piston and cylinder jack assemblies is provided with both thereof mountable on each side of the polished rod member for additional pulling power and to equally extend said winged rod clamp assembly on actuation of said piston and cylinder jack assemblies.

8. A polished rod liner puller assembly as described in claim 1, including:

(a) an extension tube assembly having a first split tube member of semi-circular shape used as a shim to achieve further axial and longitudinal movement of the polished rod member when removing the polished rod liner member from the well.

9. A polished rod liner puller assembly as described in claim 2, wherein:

(a) said base plate assembly having a U-shaped slot portion therein to be aligned with said slot portions in said upper and lower plate members of said work table assembly and vertically aligned therewith so as to be mountable about the well casing head assembly.

10. A method of use utilizing the polished rod liner puller assembly of this invention in order to remove a polished rod liner member of a polished rod liner assembly from a well pump operation, comprising:

(a) placing a well pumper assembly being worked upon in a down stroke position;

(b) mounting a work table assembly of said polished rod liner puller assembly about a well casing head assembly and a polished rod member of said polished rod liner assembly which is extended upwardly therefrom;

(c) placing a base plate assembly on said work table assembly;

(d) connecting a piston and cylinder jack assembly to said base plate assembly;

(e) connecting a winged rod clamp assembly to said piston and cylinder jack assemblies;

(f) securing said winged rod clamp assembly to an upper portion of the polished rod member;

(g) actuating said piston and cylinder jack assembly to raise the polished rod member;

(h) removing a bridle clamp member on the well pump assembly to disengage same from the piston rod member;

(i) extending the piston and cylinder jack assemblies to move the polished rod member and interconnected polished rod liner member from a well being worked upon;

(j) removing and replacing the old polished rod liner member with a new one; and (k) removing the polished rod liner puller assembly of this invention and activating the well pump assembly into its normal mode of a well pumping operation.

11. A method as described in claim 10, including:

(a) measuring the distance between a bridle clamp member to the polished rod liner member after setting the well pumper assembly in the down stroke position to assure proper installation of a new polished rod liner member.

12. A method as described in claim 10, including:

(a) measuring a distance from the bridle clamp member to a top surface of the polished rod member in order to correctly position a new polished rod liner member on the polished rod member on reassembling same to continue the well pumping operation.

13. A method as described in claim 10, including:

(a) opening a valve member to relieve any fluid pressure in the well pump assembly and prevent backflow of fluid to the well.

14. A method as described in claim 10, including:

(a) before extending the piston and cylinder jack assembly, releasing a rod liner nut member from connection between the polished rod member and the polished rod liner member.

15. A method as described in claim 10, including:

(a) after removing and replacing the old polished rod liner member, reconnecting a rod liner nut member about a new polished rod liner member.

* * * * *